United States Patent [19]

Schienbein

[11] 4,258,488

[45] Mar. 31, 1981

[54] PHONOGRAPH RECORD ALBUM DISPLAY FRAME

[76] Inventor: Jack D. Schienbein, 12869 Gladstone Ave., Sylmar, Calif. 91342

[21] Appl. No.: 945,583

[22] Filed: Sep. 25, 1978

[51] Int. Cl.[3] ..... G09F 1/12

[52] U.S. Cl. ..... 40/152; 40/124.2

[58] Field of Search ..... 40/152, 152.1, 153, 40/154, 155, 156, 158 R, , 158 B, 159, 124.2, 209

[56] References Cited

U.S. PATENT DOCUMENTS

| | | | |
|---|---|---|---|
| 2,958,971 | 11/1960 | Plettner | 40/156 X |
| 3,195,258 | 7/1965 | Gwin | 40/158 R |
| 3,958,348 | 5/1976 | Sakamoto | 40/158 R X |
| 4,041,630 | 8/1977 | Holbrook | 40/152.1 |

*Primary Examiner*—John F. Pitrelli

*Attorney, Agent, or Firm*—Blakely, Sokoloff, Taylor & Zafman

[57] ABSTRACT

A frame for displaying phonograph record album covers. The frame also provides an effective means for storing phonograph record albums. The inner periphery of the frame defines an opening which is slightly larger than an album cover so that a cover can be mounted within the frame by simply placing the cover on the upper surface of the bottom frame section. The album cover rests within the frame with the top of the cover tilted slightly inwardly. Grooves or bosses are framed in the lower frame section for the purpose of preventing the bottom edge of the tilted cover from sliding off the frame section. Removal of the album cover is accomplished by applying fingertip force to the lower portion of the album cover thereby causing the lower edge of the cover to move out of the groove or bosses towards the rear of the frame. When the cover is approximately vertical, the upper edge of the cover will fall forward into the hand of the user.

5 Claims, 6 Drawing Figures

PHONOGRAPH RECORD ALBUM DISPLAY FRAME

BACKGROUND OF THE INVENTION

1. Field of the Invention

The invention relates to the field of display frames, and more particularly to the field of frames for displaying phonograph record album covers. The invention is also useful for storing phonograph records.

2. Prior Art

Display frames for phonograph record album covers provide an economical means for attractively decorating a room. Display frames are also useful for storing phonograph records. Ideally, such frames should be low in cost. Furthermore, the frame should be designed to permit easy record album mounting and removal so that the album on display can be readily changed or removed for playing. Also, an ideal frame would be designed in a manner which would permit several frames to be mounted on a wall near or adjacent to one another so that there will be greater flexibility in decorating a wall. For example, an attractive effect can be achieved by covering an entire wall with album covers.

Phonograph record album frames now on the market possess several shortcomings. First, the prior art frames are typically complicated and expensive to manufacture. Second, these frames are not designed to facilitate ease of album mounting and removal. For example, the album covers are normally mounted and removed by sliding the cover in and out of a slot formed in the edge of the frame. This is a two-handed operation which requires one to grip the frame with one hand and the album cover with the other hand. Furthermore, such prior art frames cannot be mounted closely together on a wall since such mounting would interfere with album cover mounting and removal accomplished by passing the cover through the slot formed in the frame edge.

SUMMARY OF THE INVENTION

A frame is disclosed for displaying phonograph record album covers. The frame also provides an effective means for storing phonograph record albums. The frame, which is preferably of unitary construction and manufactured from a thin gauge high-impact plastic, includes four frame sections which define a front opening slightly larger than an album cover. An album cover is mounted in the display frame by simply placing the cover within the opening with the lower edge of the cover resting on the upper surface of the lower frame section. The album cover rests within the frame with the top of the cover tilted slightly inwardly so as to prevent the cover from falling out of the frame. Grooves or bosses are formed in the lower frame section for the purpose of preventing the album cover from sliding off the lower frame section.

Removal of the album cover is accomplished by applying fingertip force to the lower portion of the album cover thereby causing the lower edge of the cover to move out of the groove or bosses towards the rear of the frame. When the cover is approximately vertical, the upper edge of the cover will fall forward into the hand of the user. A depression is formed in the central portion of the lower frame section for facilitating album cover removal. The depression serves as an index by indicating the proper point to apply force on the album cover. Furthermore, the depression provides an alternative method of removing the cover by permitting one to place a finger between the bottom edge of the cover and the lower frame section so that the cover may be lifted out of the frame.

DETAILED DESCRIPTION OF THE INVENTION

Figure 1:
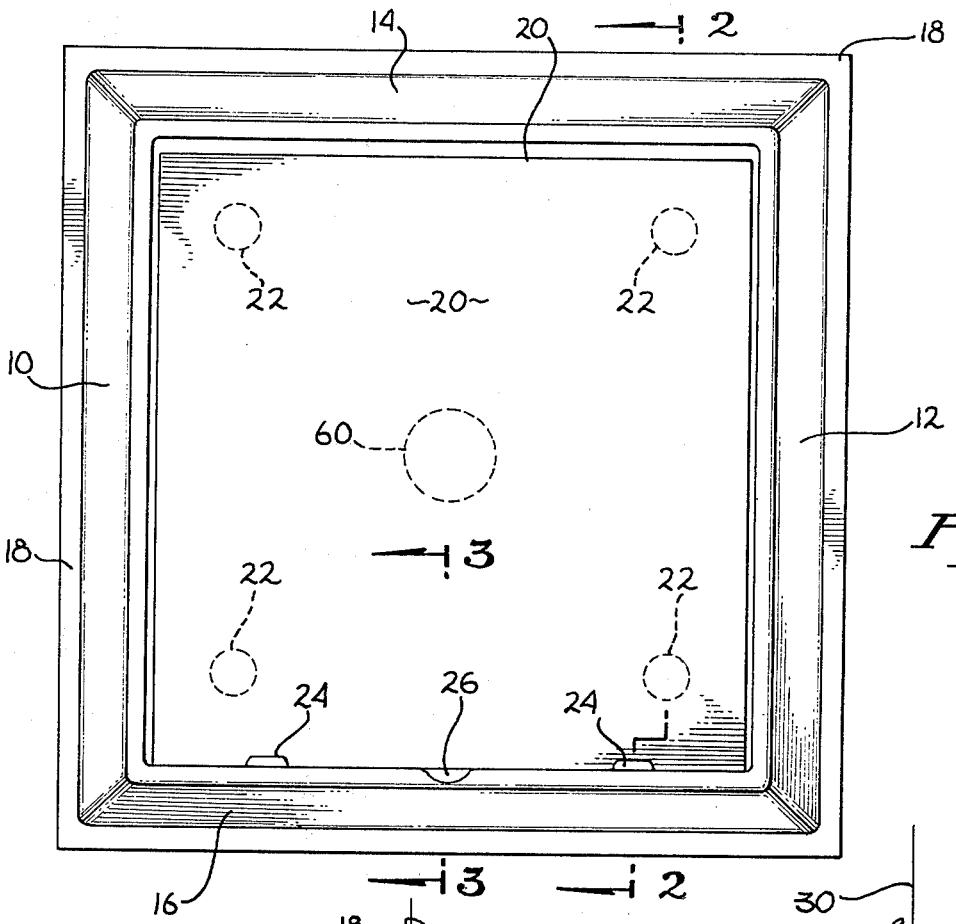
FIG. 1 is a front view of one embodiment of the phonograph album display frame.

Referring now to the drawings, a front view of one embodiment of the invention with a phonograph record album cover 20 mounted therein may be seen in FIG. 1. The display frame shown is of unitary construction and is preferably vacuum-formed from a single sheet of high-impact thermoplastic. Of course, other manufacturing techniques could also be used such as injection molding, casting and machining. Similarly, materials other than thermoplastic would also be suitable such as wood, metal or ceramic. The display frame includes left and right side frame sections 10 and 12, respectively, an upper frame section 14 and a lower frame section 16. The frame sections 10, 12, 14 and 16 define a generally rectangular-shaped opening in the frame which is slightly larger than the album cover 20.

A rim or lip 18 is left in the periphery of each frame section following the vacuum-forming process for decorative purposes. Also, the edges of rim 18 can be readily trimmed with a cutting die so that they are smooth and free of imperfections. Although rim 18 and the frame sections 10, 12, 14 and 16 are shown plain, it is apparent that various designs can be formed into these members for the purpose of simulating wood or otherwise altering the overall appearance of the display frames.

Figure 2:
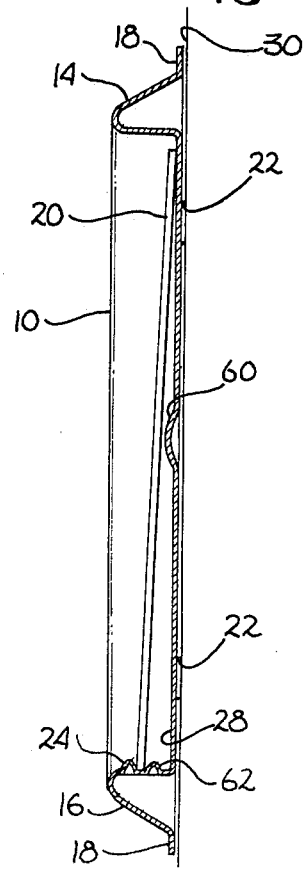
FIG. 2 is a cross-sectional side view of the display frame taken through section line 2—2 of FIG. 1.
Figure 3:
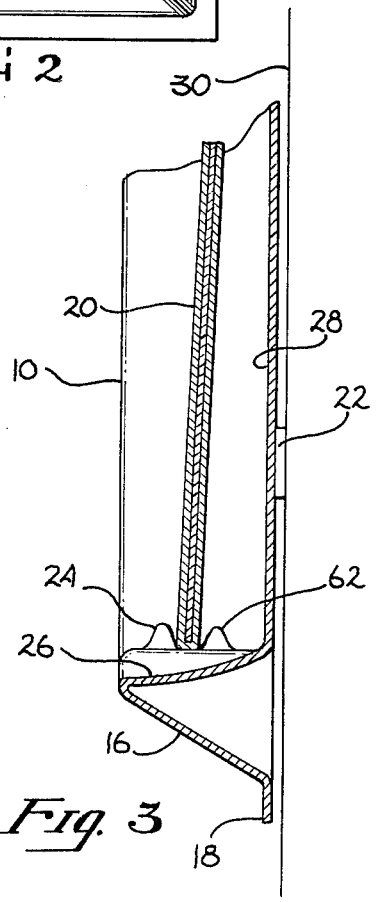
FIG. 3 is a fragmentary cross-sectional side view of the display frame taken through section line 3—3 of FIG. 1.

As can best be seen in FIGS. 2 and 3, the display frame further includes an integral base region 28 disposed between the frame sections 10, 12, 14 and 16. Base region 28, which lies in the same plane as does rim 18, is used for supporting the frame on a mounting surface or wall 30. The frame shown utilizes four adhesive tabs 22 attached to base region 28. Tabs 22 adhere to the wall or mounting surface and are more than adequate for supporting the lightweight frame and the album cover 20 mounted therein. Of course, other suitable mounting means could also be used as long as the frame is secured to the wall or surface in a substantially vertical position. A raised area 60 is formed in the central portion of the base region to facilitate removal of the album cover. The dimensions and location of the raised area are not critical, therefore the area could be in the form of raised or embossed lettering.

Album cover 20 is mounted in the display frame with the lower edge of the cover resting on the upper surface of the lower frame section 16 at a point on the surface slightly displaced from the base region 28. Two pairs of bosses, each comprised of individual bosses 24 and 62, are formed in the lower frame section 16. The boss pairs serve to properly locate the lower edge of the album cover 20 on the frame section and restrict lateral movement of the cover either towards or away from the base region 28. Although two spaced-apart pairs of bosses are preferable, spaced-apart individual bosses such as bosses 24 would also be adequate, as would a single boss disposed on the lower frame section roughly equidistant from the side frame sections 10 and 12. Both of these alternative boss arrangements require that the lower edge of the cover be placed on the lower frame section adjacent and immediately behind the boss or bosses, as the case may be, so that the cover will be properly tilted.

A depression 26 is formed in the central region of the upper surface of the lower frame section 16 to facilitate removal of the album cover 20. The depression is preferably of sufficient size to permit one to place a finger under the cover 20 so that the cover can be lifted high enough for the lower edge of the cover to clear bosses 24, thereby permitting the cover to be removed from the frame. Of course, the height of the opening defined by the frame sections 10, 12, 14 and 16 must be large enough to allow the cover to be lifted the required distance.

Figure 4:
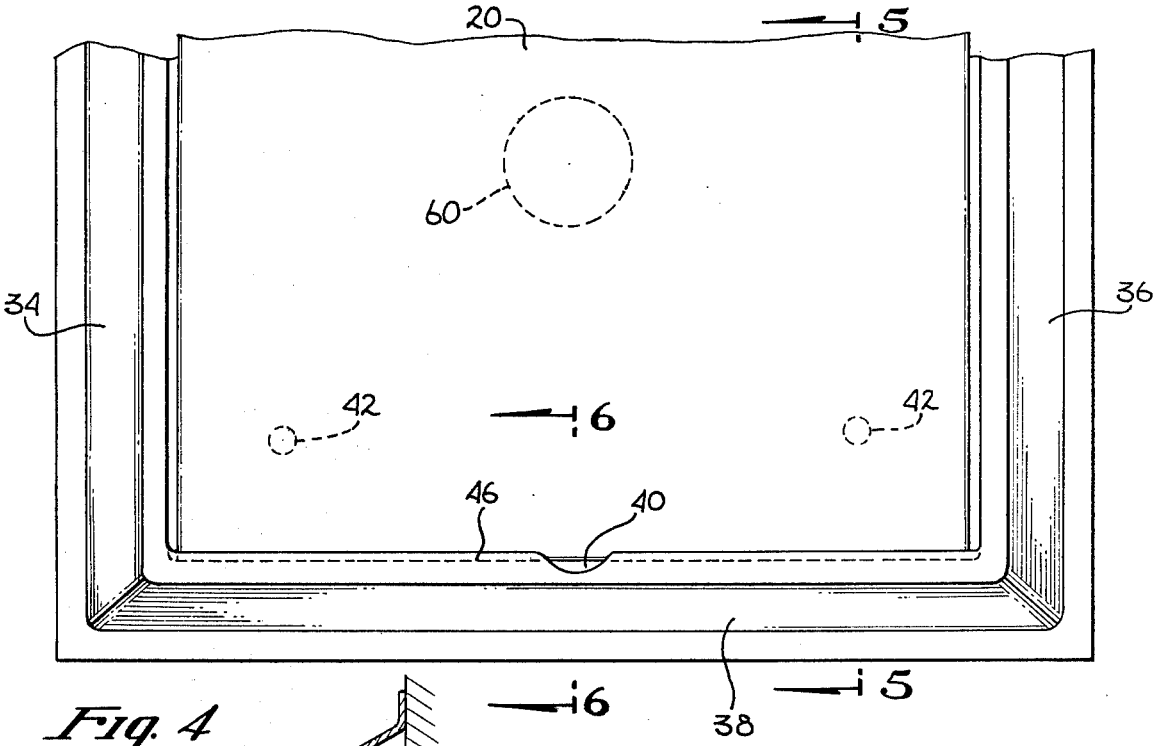
FIG. 4 is a fragmentary front view of a second embodiment of the invention.
Figure 5:
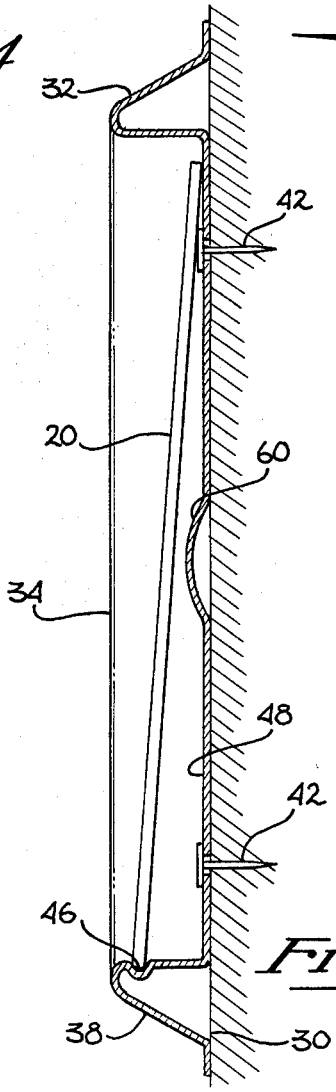
FIG. 5 is a cross-sectional side view of the display frame taken through section line 5—5 of FIG. 4.
Figure 6:
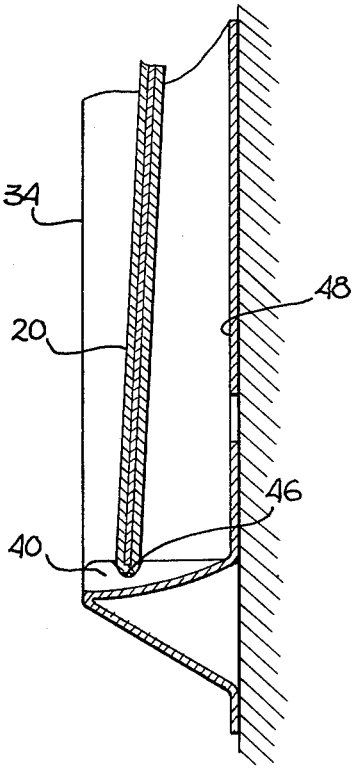
FIG. 6 is a fragmentary cross-sectional side view of the frame taken through section line 6—6 of FIG. 4.

A second embodiment of the invention is shown in FIGS. 4, 5 and 6. This embodiment also includes a left frame section 34, a right section 36, an upper section 32, a lower section 38 and a base region 48 with a raised area 60 formed in the central portion thereof. The frame further includes an opening formed in each corner area of the base region. These openings are adapted to receive nails 42 for mounting the frame to a wall or other surface. Of course, adhesive tabs such as the tabs 22 used in the first embodiment frame would also be suitable for mounting purposes.

The album cover 20 is mounted on the second embodiment display frame in substantially the same manner as the cover in the first embodiment frame. The primary distinction is that the cover 20 is held in the frame by a groove 46 formed in the lower frame section 38. The groove 46 extends along most of the length of the lower frame section 38 and is of sufficient width to accept the lower edge of the album cover 20. A depression 40, similar to the depression 26 of the first embodiment frame, is formed in the lower frame section 38.

Operation of either embodiment of the subject invention is straightforward. The frame is first mounted on a wall using either adhesive tabs, nails or the like. A record album cover 20, to be stored and/or displayed, is preferably gripped by the user at the upper edge. The user then places the cover into the frame with the lower edge of the cover resting on the lower frame section between the bosses 24 and 62 or in groove 46, as the case may be, and with the upper edge adjacent the base region.

Album cover removal is accomplished in either embodiment by forcing the lower portion of the cover towards the frame base region, thereby causing the cover to come into contact and pivot about the raised area 60, which acts as a fulcrum. Removal can be performed using one hand by forcing the cover with one's index fingertip with the palm of the hand extended upwardly. The force causes the lower edge of the cover to pass over bosses 62 or lift out of groove 46, as the case may be, so as to cause the cover to pivot about the raised area. The top edge of the cover will then tilt outwardly, causing the cover to drop forward out of the frame into the user's palm.

It has been found that the raised area in the base region is not absolutely necessary. When the lower edge of the album cover is forced against the base region of frames not having a raised area, the vertical cover is placed in a state of unstable equilibrium causing the top edge eventually to tilt outwardly away from the base region. A raised area is desirable, however, since the pivoting action provides a more positive method of album removal.

The depression formed in the lower frame section of both embodiments serves a two-fold purpose. First, the depression provides a convenient indexing point for applying force to the album cover. Secondly, it provides an alternative method for removing the cover from the frame wherein a fingertip is placed in the depression between the lower edge of the cover and the lower frame section. The cover can then be lifted upwardly until the lower edge clears the bosses 24 or is lifted out of groove 46, thereby permitting the cover to be removed from the frame.

There has been described herein two embodiments of the present invention. It is to be noted, however, that alternative embodiments may be readily fabricated by one skilled in the art. Thus, while two embodiments of the present invention have been described herein, various changes in the form and detail may be made therein without departing from the spirit and scope of the invention.

I claim:

1. A frame for displaying a phonograph record album and the like comprising:

(a) substantially parallel upper and lower frame sections secured to substantially parallel left and right frame sections to form a substantially rectangular shaped opening having a length and width at least as great as said album;

(b) a base section coupled to said frame sections and extending in a vertical plane, said base section forming a back panel of said frame;

(c) holding means for holding the bottom edge of said album, said holding means being disposed in said lower frame section at a distance from said base region so that when said album is resting in said frame the plane of said album forms an angle with the vertical, with the top edge of said album resting against the upper portion of said base region and the bottom edge of said album being held by said holding means;

(d) a raised area disposed in said base region approximately centrally between said left and right frame sections and below the area of said base region where the top edge of the album would rest when it is resting in said frame;

whereby said album is insertable into said frame by placing the bottom edge of said album into said holding means and pushing the top edge of said frame against said base region and is removable from said frame by pushing the bottom edge of said album out of said holding means and to the base region thereby causing the album to contact said raised area and pivot thereabout such that the equilibrium of said album is changed with the result that said album topples out of said frame.

2. The frame of claim 1 wherein said holding means comprises a shallow groove extending substantially along the length of the upper surface of said lower frame section.

3. The frame of claim 1 wherein said holding means comprises at least a pair of bosses extending upward from the upper surface of said lower frame section.

4. The frame of claim 1 wherein said lower frame section has a depression disposed in its upper surface, said depression extending from the front of said lower frame section to at least said holding means.

5. The frame of claim 1 wherein said frame is vacuum-formed from a single sheet of plastic.

* * * * *